US005775551A

United States Patent [19]

Tordsen

[11] Patent Number: 5,775,551

[45] Date of Patent: Jul. 7, 1998

[54] CAULKING NOZZLE

[76] Inventor: Gordon John Tordsen, 747 Lewelling Blvd. #18, San Leandro, Calif. 94571

[21] Appl. No.: 686,515

[22] Filed: Jul. 26, 1996

[51] Int. Cl.[6] ..... B67D 25/48

[52] U.S. Cl. ..... 222/567; 222/570; 401/266; 425/87

[58] Field of Search ..... 222/191, 391, 222/567, 570, 575; 401/266; 425/87, 458

[56] References Cited

U.S. PATENT DOCUMENTS

| | | | |
|---|---|---|---|
| 721,168 | 2/1903 | Egert | 425/458 |
| 3,087,654 | 4/1963 | Moore | 222/567 X |
| 4,570,834 | 2/1986 | Ward | 222/575 X |
| 4,981,629 | 1/1991 | Cook | 401/266 X |
| 5,000,361 | 3/1991 | Briddell et al. | 222/575 |
| 5,010,618 | 4/1991 | Croft | 425/87 X |
| 5,017,113 | 5/1991 | Heaton et al. | 222/575 X |
| 5,033,951 | 7/1991 | Cook | 425/87 |
| 5,046,877 | 9/1991 | Longo | 222/575 X |
| 5,249,876 | 10/1993 | Hattman | 401/266 X |

*Primary Examiner*—Kenneth Bomberg

[57] ABSTRACT

A caulking nozzle includes an elongated tube dimensioned for coupling with a caulk tube. A pair of planar side walls each has an upper end portion and a lower end portion. Each lower end portion is integral with each other with the pair of side walls in an orthogonal relationship to each other. The lower end portions are integral with a distal end of the elongated tube. Each lower end portion has a channel formed therein. Each channel has a first end portion and a second end portion. Each first end portion extends within the distal end of the elongated tube. Each second end portion opens out distal ends of the lower end portions.

1 Claim, 2 Drawing Sheets

CAULKING NOZZLE

BACKGROUND OF THE INVENTION

1. Field of the Invention

The present invention relates to a caulking nozzle and more particularly pertains to caulking a ninety degree angle corner with a caulking nozzle.

2. Description of the Prior Art

The use of caulking spouts is known in the prior art. More specifically, caulking spouts heretofore devised and utilized for the purpose of distributing filler material are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,249,876 to Hattman discloses a caulking nozzle.

U.S. Pat. No. 4,101,077 to Gibson discloses a caulking spout.

U.S. Pat. No. Des. 333,955 to Hatgas et al. discloses the ornamental design for a tip for a dispenser of caulking, adhesive or sealant.

U.S. Pat. No. 4,878,599 to Greenway discloses a caulking nozzle.

U.S. Pat. No. 4,380,425 to Edelman discloses a caulking spout.

U.S. Pat. No. 4,951,876 to Mills discloses a spray tip for a caulking tube.

While these devices fulfill their respective, particular objective and requirements, the aforementioned patents do not describe a caulking nozzle for caulking a ninety degree angle corner.

In this respect, the caulking nozzle according to the present invention substantially departs from the conventional concepts and designs of the prior art, and in doing so provides an apparatus primarily developed for the purpose of caulking a ninety degree angle corner.

Therefore, it can be appreciated that there exists a continuing need for new and improved caulking nozzle which can be used for caulking a ninety degree angle corner. In this regard, the present invention substantially fulfills this need.

SUMMARY OF THE INVENTION

In the view of the foregoing disadvantages inherent in the known types of caulking spouts now present in the prior art, the present invention provides an improved caulking nozzle. As such, the general purpose of the present invention, which will be described subsequently in greater detail, is to provide a new and improved caulking nozzle and method which has all the advantages of the prior art and none of the disadvantages.

To attain this, the present invention essentially comprises an elongated tube having an open first end and a second end. The open first end is dimensioned for coupling with a caulk tube. The device includes a pair of planar side walls. Each of the side walls has an upper end portion and a lower end portion. Each lower end portion is integral with each other with the pair of side walls in an orthogonal relationship to each other. The lower end portions is integral with the second end of the elongated tube. Each lower end portion has a channel formed therein. Each channel has a first end portion and a second end portion. Each first end portion extends within the second end of the elongated tube at a forty-five degree angle. Each second end portion opens out distal ends of the lower end portions. The pair of planar side walls has lengths slightly less than a length of the elongated tube.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved caulking nozzle which has all the advantages of the prior art caulking spouts and none of the disadvantages.

It is another object of the present invention to provide a new and improved caulking nozzle which may be easily and efficiently manufactured and marketed.

It is a further object of the present invention to provide a new and improved caulking nozzle which is of durable and reliable construction.

An even further object of the present invention is to provide a new and improved caulking nozzle which is susceptible of a low cost of manufacture with regard to both materials and labor, and which accordingly is then susceptible of low prices of sale to the consuming public, thereby making such a caulking nozzle economically available to the buying public.

Still yet another object of the present invention is to provide a new and improved caulking nozzle which provides in the apparatuses and methods of the prior art some of the advantages thereof, while simultaneously overcoming some of the disadvantages normally associated therewith.

Even still another object of the present invention is to provide a new and improved caulking nozzle for caulking a ninety degree angle corner.

Lastly, it is an object of the present invention to provide a new and improved caulking nozzle includes an elongated tube dimensioned for coupling with a caulk tube. A pair of planar side walls each has an upper end portion and a lower end portion. Each lower end portion is integral with each other with the pair of side walls in an orthogonal relationship to each other. The lower end portions are integral with a distal end of the elongated tube. Each lower end portion has a channel formed therein. Each channel has a first end portion and a second end portion. Each first end portion extends within the distal end of the elongated tube. Each second end portion opens out distal ends of the lower end portions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
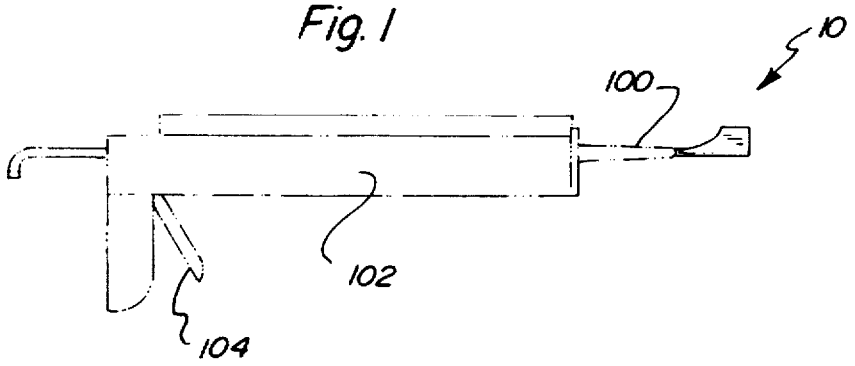
FIG. 1 is a side view of the present invention coupled with a caulk tube.
Figure 2:
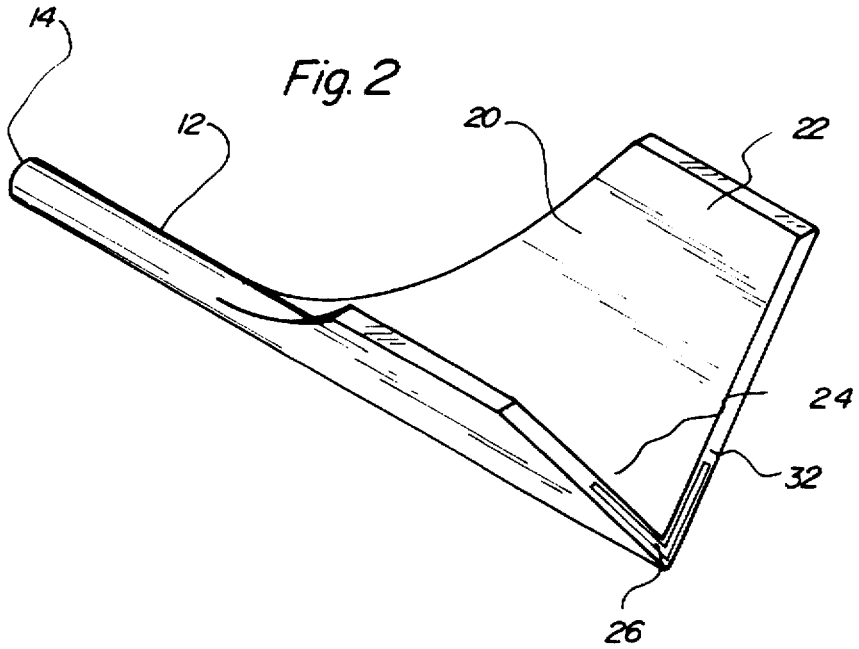
FIG. 2 is a perspective view of the preferred embodiment of the caulking nozzle constructed in accordance with the principles of the present invention.
Figure 3:
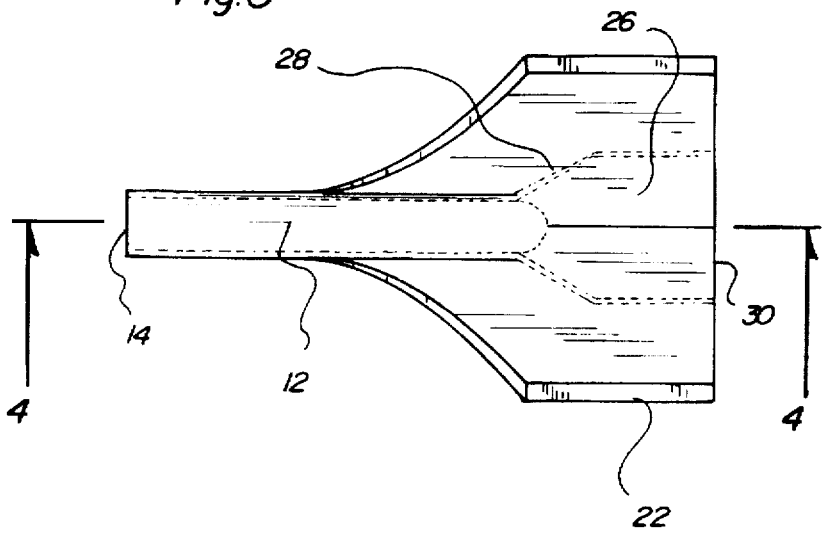
FIG. 3 is a plan view of the preferred embodiment of the present invention.
Figure 4:
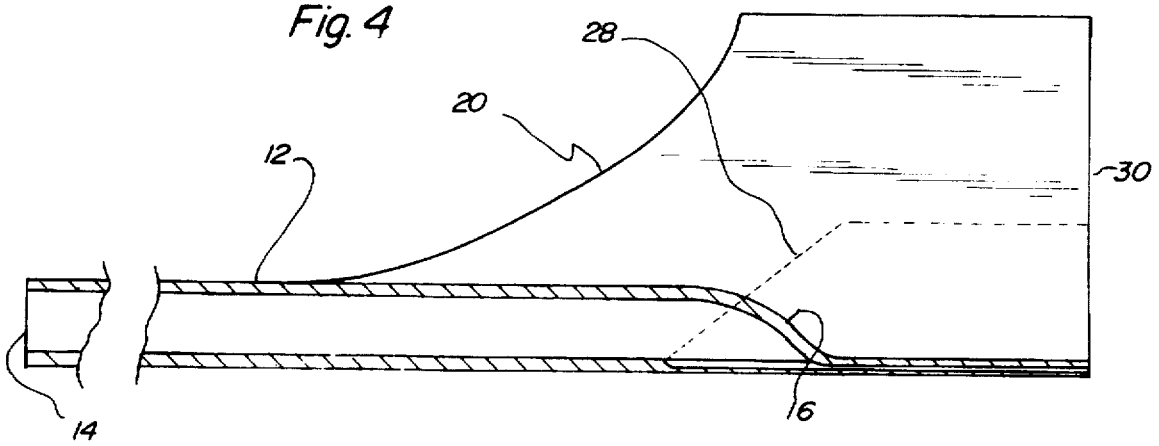
FIG. 4 is a cross-sectional view as taken along line 4—4 of FIG. 3.

With reference now to the drawings, and in particular, to FIGS. 1–4 thereof, the preferred embodiment of the new and improved caulking nozzle embodying the principles and concepts of the present invention and generally designated by the reference number 10 will be described.

Specifically, it will be noted in the various FIGS that the device relates to a new and improved caulking nozzle for caulking a ninety degree angle corner. In its broadest context, the device consists of an elongated tube and a pair of planar side walls. Such components are individually configured and correlated with respect to each other so as to attain the desired objective.

The device 10 includes an elongated tube 12 having an open first end 14 and a second end 16. The open first end 14 is dimensioned for coupling with a caulk tube 100. The open first end 14 is pushed within an opening in the caulk tube 100. The caulk tube 100 is coupled with a caulk gun 102 for distribution of filler out of the caulk tube 100 to be received within the open first end 14 of the elongated tube 12.

The device 10 includes a pair of planar side walls 20. Each of the side walls 20 has an upper end portion 22 and a lower end portion 24. Each lower end portion 24 is integral with each other with the pair of side walls 20 in an orthogonal relationship to each other. The lower end portions 24 are integral with the second end 16 of the elongated tube 12. Each lower end portion 24 has a channel 26 formed therein. Each channel 26 has a first end portion 28 and a second end portion 30. Each first end portion 28 extends within the second end 16 of the elongated tube 12 at a forty-five degree angle. The forty-five degree angle of the first end portions 28 allow for the filler to be properly enter into the channels 26. Each second end portion 30 opens out distal ends 32 of the lower end portions 24. The filler is distributed out of the second end portions 30 of the channels 26 once the device 10 is positioned in a ninety degree corner. Simply pressing a trigger 104 of the caulk gun 102 while applying even pressure forces filler into the ninety degree corner thereby allowing virtually no retooling and keeping excess filler from making a mess. The pair of planar side walls 20 have lengths slightly less than a length of the elongated tube 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A caulking nozzle for caulking a ninety degree angle corner comprising, in combination:

an elongated cylindrical tube having an open first end and a second end, the open first end dimensioned for being pushed within an opening of a caulk tube for receiving filler therefrom;

a pair of planar side walls, each of the side walls having an upper end portion and a lower end portion, each lower end portion integral with each other with the pair of side walls in an orthogonal relationship to each other, the lower end portions integral with the second end of the elongated tube, each lower end portion having a channel formed therein, each channel having a first end portion and a second end portion, each first end portion extends within the second end of the elongated tube at a forty-five degree angle for allowing the filler to be properly received by the channels, each second end portion opening out distal ends of the lower end portions for distributing the filler in a 90 degree corner, the channels each having a length less than ½ that of the corresponding side wall, the pair of planar side walls having lengths slightly less than a length of the elongated tube.

* * * * *